US005302043A

United States Patent [19]

Velliquette

[11] Patent Number: 5,302,043

[45] Date of Patent: Apr. 12, 1994

[54] DISC SHAPED ABSORBENT WHEEL FOR APPLYING A STRIP OF SEALER

[76] Inventor: Stephen P. Velliquette, 4411 Bee Ridge Rd., Suite 593, Sarasota, Fla. 34233

[21] Appl. No.: 9,298

[22] Filed: Jan. 26, 1993

[51] Int. Cl.[5] ..... B05C 17/035; B05C 17/02

[52] U.S. Cl. ..... 401/208; 401/219; 401/48; 401/193; 15/230.11

[58] Field of Search ..... 401/208, 197, 218, 219, 401/220, 48, 193; 15/166, 230, 230.11, 230.14, 244.1, 244.4

[56] References Cited

U.S. PATENT DOCUMENTS

| | | | |
|---|---|---|---|
| 342,484 | 5/1886 | Wade | 401/208 |
| 1,965,753 | 7/1934 | Scoles | 401/176 |
| 2,563,842 | 8/1951 | Johnson | 401/208 X |
| 2,761,167 | 9/1956 | Bridgford | 15/230.11 X |
| 2,816,308 | 12/1957 | Schultz | 401/193 |
| 2,827,649 | 3/1958 | Perry | 401/219 |
| 3,186,024 | 6/1965 | McLemore | 401/208 X |
| 3,274,637 | 9/1966 | Schulze | 401/208 |
| 3,448,722 | 6/1969 | Krizman | 401/48 |
| 4,150,904 | 4/1979 | Stewart | 401/219 X |
| 4,212,556 | 7/1980 | Kohler | 401/208 |

FOREIGN PATENT DOCUMENTS

| | | | |
|---|---|---|---|
| 2061455 | 5/1981 | United Kingdom | 15/230.11 |

*Primary Examiner*—Danton D. DeMille
*Attorney, Agent, or Firm*—Charles J. Prescott

[57] ABSTRACT

A striper wheel (6) has a standard flat washer shaped, absorbent member (2). Absorbent member (2) is securely fastened by any means between two rigid supports (4, 4A). Also of a flat washer shape. Absorbent member (2) has a slightly larger circumference than support members (4, 4A).

2 Claims, 2 Drawing Sheets

DISC SHAPED ABSORBENT WHEEL FOR APPLYING A STRIP OF SEALER

BACKGROUND—FIELD OF INVENTION

This invention relates to an improved striping wheel applicator of the type which is used to lay a stripe of liquid sealer to the hardened cement grout joints associated with ceramic tile or other installations.

BACKGROUND—DESCRIPTION OF PRIOR ART

In the past many types of striping devices have been known. These devices are suitable for applying a high viscosity liquid such as paint. The prior art generally includes a striper wheel having a non-absorbent serrated outer circumference. Representative prior art stripers are exemplified by U.S. Pat. Nos. 4212556, 2,816,308, 1,965,753 and 342,484. The prior art striping wheels although suitable for applying thick liquids are believed to be unsuitable for applying liquids with a thin or low viscosity, such as liquid silicone or acrylic waterproofing sealers. Additionally, the prior art devices require very close tolerances (0.002) between their parts making them expensive if not impossible to manufacture en masse.

OBJECTS AND ADVANTAGES

Accordingly, several objects and advantages of the present invention are:

A. To provide a very low cost striper wheel of simple construction from readily available sheet materials die cut into standard flat washer shapes.

B. To provide a striper wheel where it's rigid support washers prevent crushing of all but the outermost periphery of absorbent washer and significantly enhance absorbent washer's ability to hold liquid absorbed, thus creating a reservoir where liquid is absorbed and held, and it is not releasable except at extreme outer periphery of absorbent washer.

C. To provide a striper wheel that has an absorbent washer with a slightly larger circumference than it's rigid side support washers. This configuration provides assured firm contact between a grout joint and absorbent washer outer periphery, yet minimizes wear of absorbent material as it is easily compressed leaving rigid support washer's outer circumference exposed to act as wearing surface.

D. To provide a striper wheel thin enough to apply liquid neatly within the confines of grout joints as narrow as $\frac{1}{8}''$ and wider. Yet upon being supplied with liquid by any means is capable of absorbing and holding a worthwhile amount of liquid.

Upon contact between striper wheel assembly and grout joint, a specific segment of the striper wheel's absorbent material is compressed. As striper wheel is rolled this point of compression changes, compressing then releasing absorbent washer along entire circumference of striper wheel. This compressing and releasing action mostly occurs at the outermost periphery of the striper wheel assembly where absorbent material protrudes slightly past rigid support washers. When compressed the absorbent washer releases it's captive liquid to receiving surface. When absorbent material is released, expansion of absorbent material causes liquid held and otherwise trapped in the interior portion of striper wheel to be drawn to outer periphery of striper wheel ready for release when once again absorbent material is compressed as striper wheel is rolled. More simply, an automatic pumping action from interior of absorbent washer to outer periphery of same is achieved by rolling motion of striper wheel in use.

Said pumping action in addition to natural wicking ability of the absorbent washer material assures the maximum amount of grout joint area is coated between each exposure of striper wheel to liquid.

E. To provide a striper wheel that functions well when rotatability supported by either a simple handle or mounted by known means to a bottle cap which provides controllable fluid communication between striper wheel and a standard squeeze bottle storage container.

A more complete understanding of the present invention, as well as a better understanding of additional objects and advantages thereof, will be afforded to those skilled in the art from a consideration of the following detailed explanation of the preferred exemplary embodiment thereof. Reference will be made hereinafter to the drawing which will be first briefly described.

DETAILED DESCRIPTIONS

Figure 1:
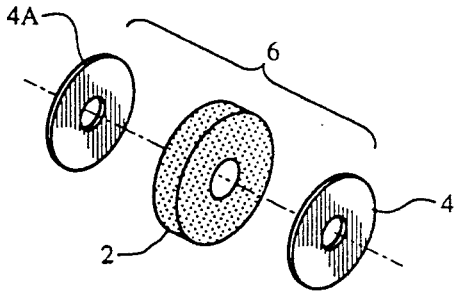
FIG. 1 is an exploded perspective view of the components of the present invention.

With reference now to FIG. 1, a striper wheel 6 has a standard flat washer shaped, absorbent member 2. Absorbent member 2 is securely fastened by any means between two rigid supports 4, 4A. Also of a flat washer shape. Absorbent member 2 has a slightly larger circumference than support members 4, 4A.

Figure 2:
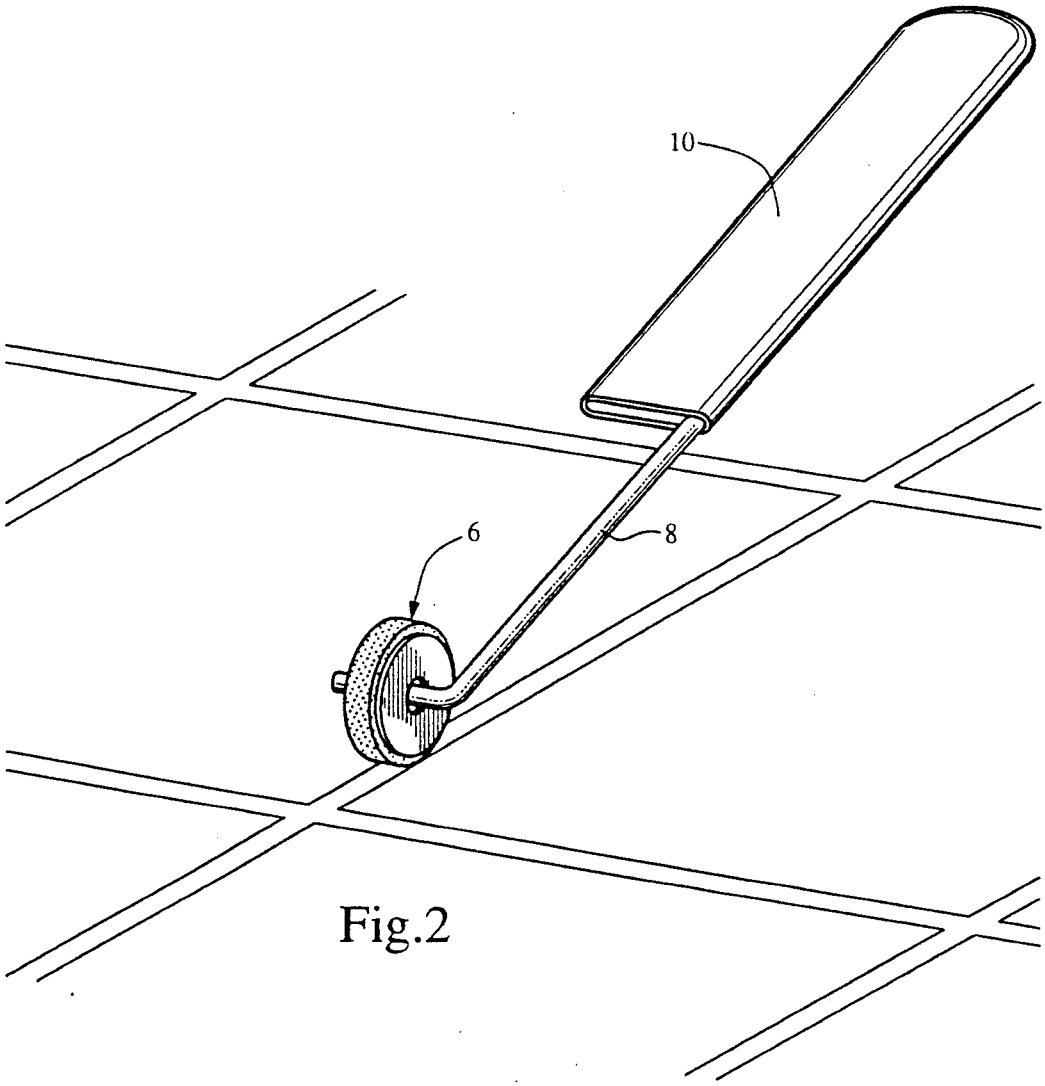
FIG. 2 is a perspective view of striper wheel rotatably mounted on a simple handle/axle configuration.

FIG. 2 illustrates striper wheel 6, rotatably mounted on Axle Assembly 8 that provides a handle 10. In this species the striper wheel 6 would be manually exposed to a separate container of liquid for loading of striper wheel 6. Once loaded, user would manually roll striper wheel 6 on surface to receive liquid, such as a cementitious grout joint common to ceramic tile and other installations.

Figure 3:
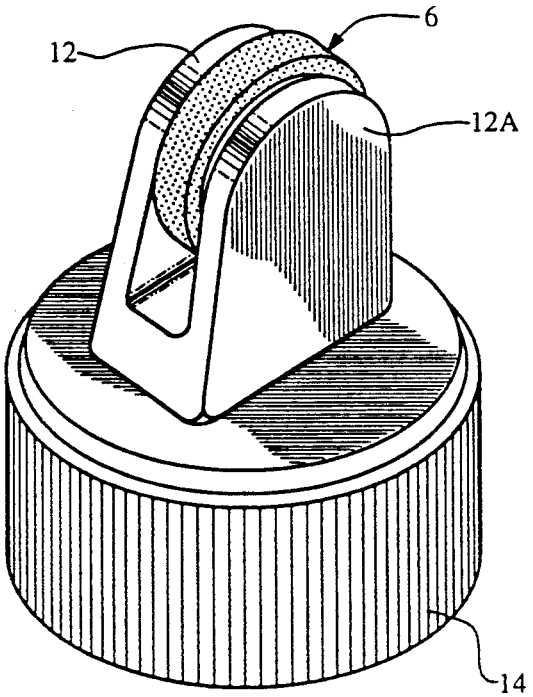
FIG. 3 is a perspective view of striper wheel rotatably mounted to a dispensing bottle cap or closure.
Figure 4:
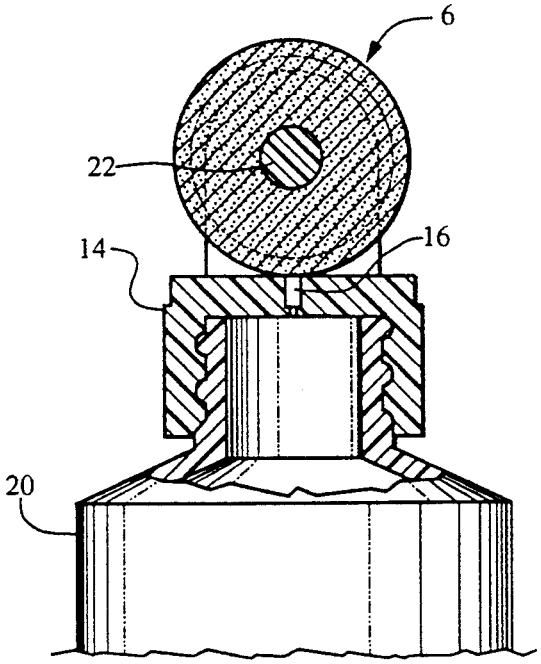
FIGS. 4 & FIG. 5 are views in section of the striper wheel rotatably mounted to a dispensing bottle cap or closure.
Figure 5:
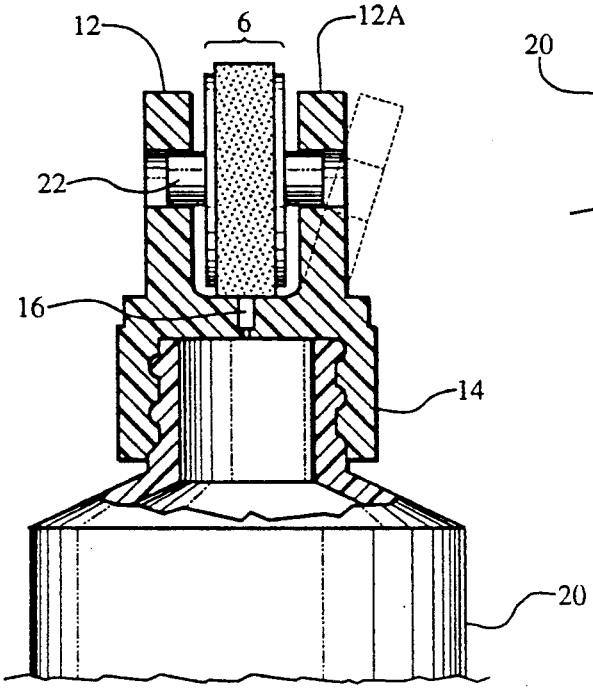

FIGS. 3, 4 & 5 show striper wheel 6 rotatably supported by a pair of parallel arms 12, 12A extending outwardly from the upper portion of a squeeze bottle cap 14. Cap 14 would integrally incorporate a valving means 16 to allow user to control flow rate of liquid to striper wheel 6 from a standard squeeze bottle 20.

FIG. 5 illustrates one mounting means which incorporates an axle pin 22.

With the foregoing in mind we claim:

1. A striper device for holding a quantity of low viscosity liquid sealer comprising:

a handle having an axle disposed at one end thereof;

a single compressible disc-shaped absorbent member having a continuous, unbroken width substantially less than a diameter thereof and mounted for rotation on said axle, said absorbent member capable of absorbing the quantity of liquid sealer;

a rigid disc-shaped washer positioned for rotation on said axle on both sides of and directly against said absorbent member;

said absorbent member being slightly larger in diameter than, and in close proximity to, a common diameter of said washers to define a radially extending outer periphery of said absorbent member;

said periphery being compressible to release liquid sealer from said absorbent member into a grout joint only of a tile surface when said washers are rolled along, and in contact with, either edge of the grout joint to define an area of application of the liquid sealer and to support said absorbent member in contact with the grout joint;

said absorbent member having a thickness no larger than a width of the grout joint, said washers preventing the liquid sealer from flowing onto the tile surface.

2. A striper device as set forth in claim 1, wherein said handle includes:

a bottle for storing a large volume of the liquid sealer therein;

a cap threadably engagable onto an open end of said bottle;

said cap including two parallel spaced arms which extend to support said axle;

a valving means centrally positioned in said cap for controlled flow of the liquid sealer from said bottle onto said periphery;

said valving means being positioned in very close proximity to said periphery.

* * * * *